US005864915A

United States Patent [19]

Ra

[11] Patent Number: 5,864,915

[45] Date of Patent: Feb. 2, 1999

[54] TOOTHBRUSH

[76] Inventor: Dojin Ra, 128 E. Harwood Ter., Palisades Park, N.J. 07650

[21] Appl. No.: 727,696

[22] Filed: Oct. 9, 1996

[51] Int. Cl.[6] ..... A46B 9/04

[52] U.S. Cl. ..... 15/167.1; 15/143.1; 15/176.4; D4/104

[58] Field of Search ..... 15/143.1, 162.1, 15/176.1, 176.4–176.6; D4/104, 138

[56] References Cited

U.S. PATENT DOCUMENTS

| | | | |
|---|---|---|---|
| D. 328,392 | 8/1992 | Holstein, II et al. | D4/138 X |
| D. 362,963 | 10/1995 | Brady et al. | D4/104 |
| 1,908,510 | 5/1933 | Dodson | 15/176.4 |
| 4,543,679 | 10/1985 | Rosofsky et al. | 15/167.1 X |
| 4,890,349 | 1/1990 | Nitzsche | 15/176.5 X |
| 5,339,482 | 8/1994 | Desimone et al. | 15/167.1 |
| 5,396,679 | 3/1995 | Brown et al. | 15/176.4 X |
| 5,555,590 | 9/1996 | Blum et al. | 15/176.5 X |
| 5,630,244 | 5/1997 | Chang | 15/167.1 |

FOREIGN PATENT DOCUMENTS

| | | | |
|---|---|---|---|
| 393219 | 10/1990 | European Pat. Off. | 15/167.1 |
| 2311043 | 9/1974 | Germany | 15/176.4 |
| 3038895 | 8/1982 | Germany | 15/176.4 |
| 4104314 | 8/1992 | Germany | 15/167.1 |
| 6-304021 | 11/1994 | Japan | 15/167.1 |

*Primary Examiner*—Mark Spisich
*Attorney, Agent, or Firm*—Weingram & Associates, P.C.

[57] ABSTRACT

The present invention is a toothbrush which consists of a handle constructed and arranged to receive thereto a removably mountable brushing head. The brushing head is provided with a base having a plurality of bosses which coact with the handle to removably mount the brushing head to the handle for replacement and repair. The handle is formed with an aperture extending therethrough and in registration with the brushing head. A region of the brushing head is in registration with the aperture such that the region is accessible at the aperture for being depressed to release the brushing head from the handle.

8 Claims, 8 Drawing Sheets

TOOTHBRUSH

BACKGROUND OF THE INVENTION

The present invention relates to oral hygiene devices and particularly, to toothbrushes constructed and arranged to accept interchangeable brushing heads.

The toothbrush of the present invention includes an ergonomically shaped handle portion with cushionable regions to substantially reduce, if not eliminate, damage to teeth and gums. The toothbrush also includes an interchangeable brushing head with bristles constructed and arranged along the brushing head to reach molars and wisdom teeth.

It is an object of the present invention to provide a toothbrush which includes elements constructed and arranged to facilitate gripping the toothbrush for effective oral hygiene.

It is another object of the present invention to provide a toothbrush with a handle portion having cushionable regions to facilitate gripping the toothbrush and to prevent damage from occurring to teeth and gums.

It is another object of the present invention to provide a toothbrush with an interchangeable brushing head portion so that worn or damaged brushing heads can be replaced.

It is another object of the present invention to provide an interchangeable brushing head which is removably mountable to a handle portion of the toothbrush by one hand operation.

It is another object of the present invention to provide a brushing head for a toothbrush having bristles constructed and arranged along the brushing head conducive to reaching molars and wisdom teeth.

It is another object of the present invention to provide a toothbrush with a handle portion constructed with a bulbous region to restrict movement of a user's hand along the handle portion.

BRIEF DESCRIPTION OF THE DRAWINGS

For a more complete understanding of the present invention, reference may be had to the following description of the preferred embodiments taken in conjunction with the drawings, of which.

DETAILED DESCRIPTION OF THE PREFERRED EMBODIMENTS

Figure 8:
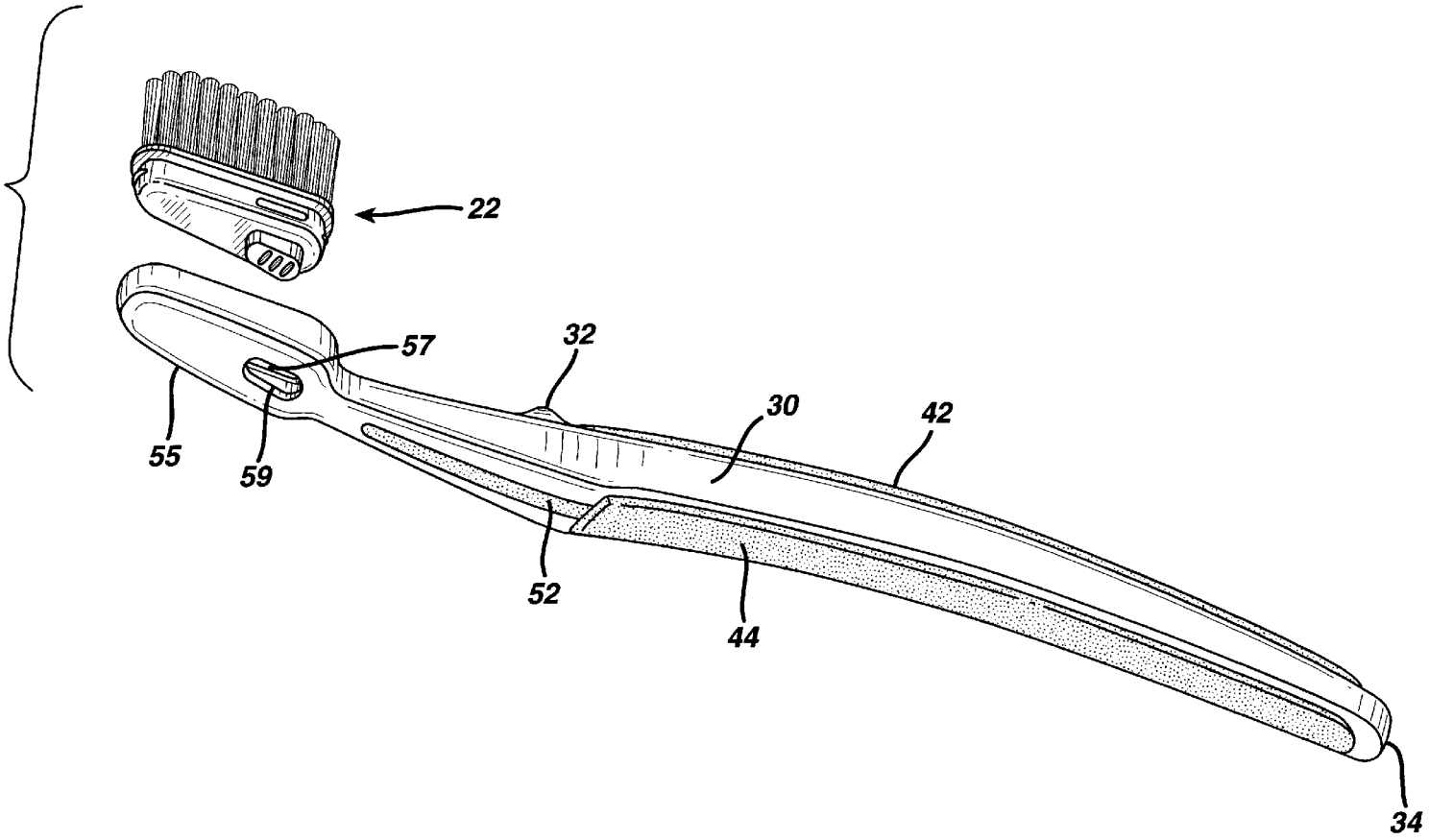
FIG. 8 is an exploded bottom perspective view.
Figure 9:
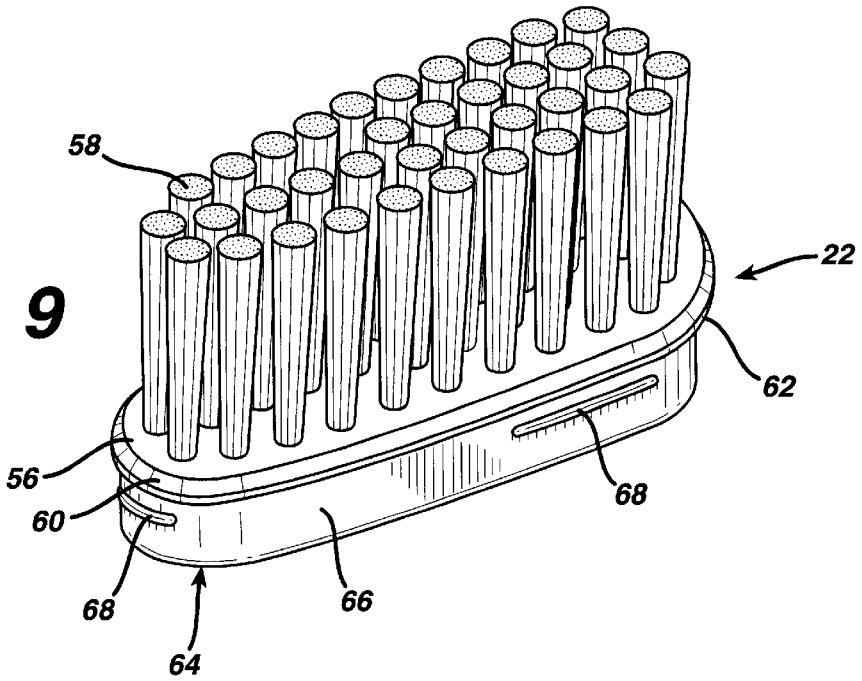
FIG. 9 is a top perspective view of a preferred embodiment of a brushing head of the toothbrush according to the present invention.
Figure 10:
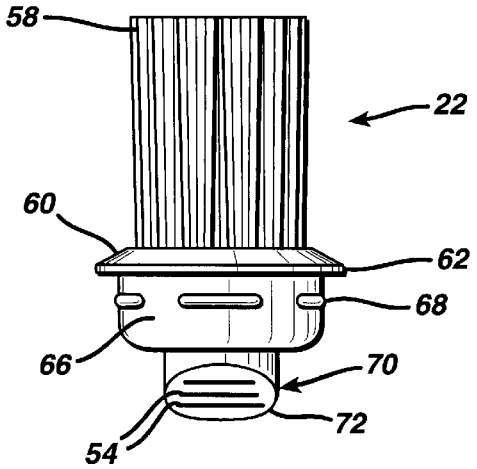
FIG. 10 is a front elevational view thereof.
Figure 11:
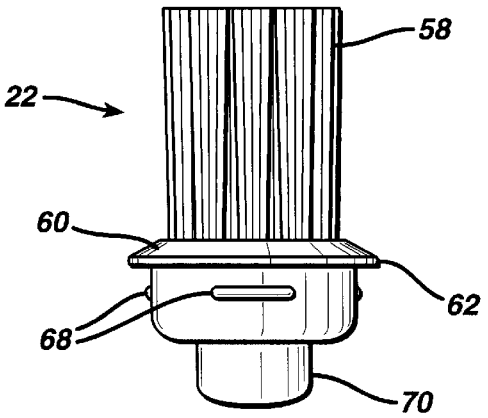
FIG. 11 is a rear elevational view thereof.
Figure 12:
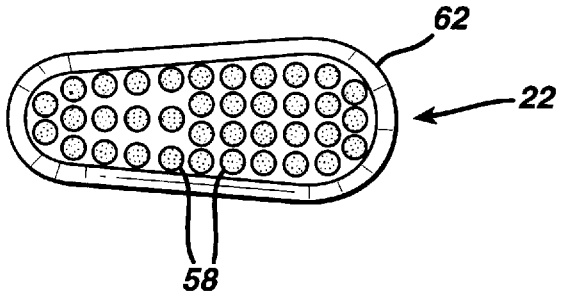
FIG. 12 is a top plan view thereof.
Figure 13:
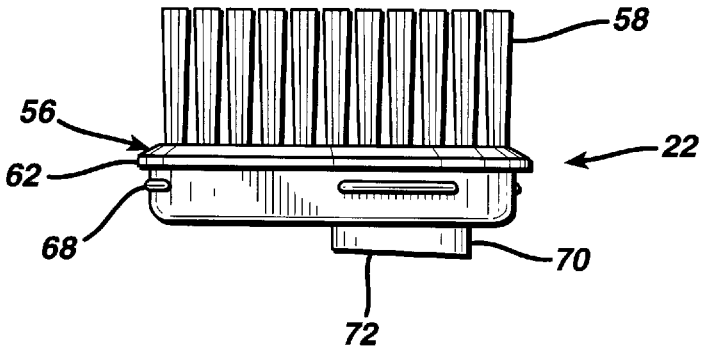
FIG. 13 is a side elevational view, the opposite side being a mirror image thereto.
Figure 14:
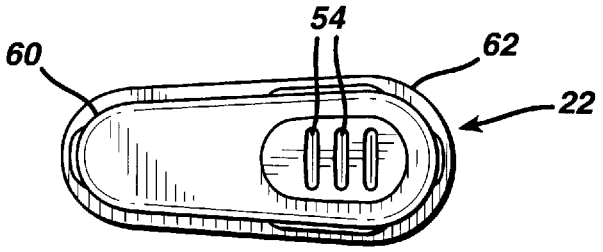
FIG. 14 is a bottom plan view thereof.
Figure 15:
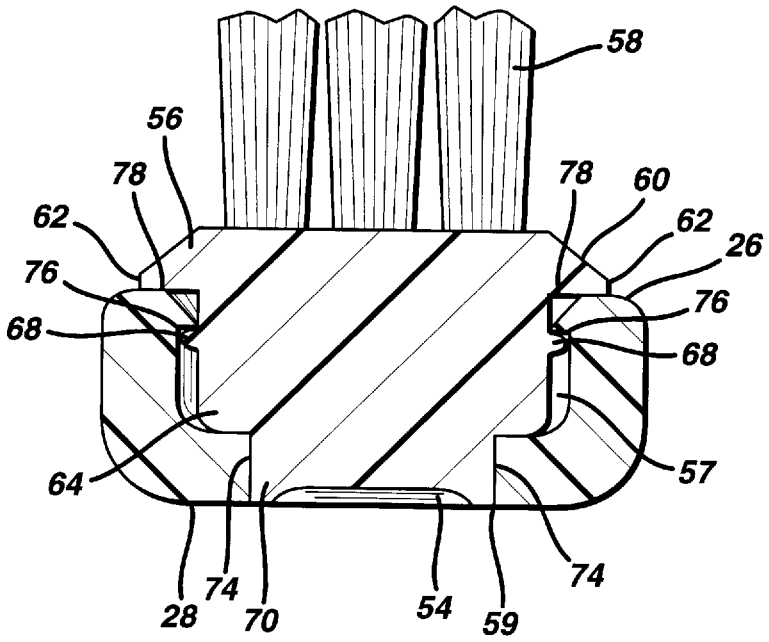
FIG. 15 is a cross sectional view of the brushing head removably mounted to the handle portion taken along line 15—15 in FIG. 1.

A toothbrush 20 according to the present invention is shown in FIGS. 1–8. An interchangeable brushing head 22 is shown in FIGS. 8–14, which is constructed and arranged to be removably mountable to a handle 24 of the toothbrush 20. FIG. 15 shows a cross sectional view through the toothbrush 20 when the brushing head 22 is removably mounted to the handle 24, as shown in FIG. 8.

Figure 1:
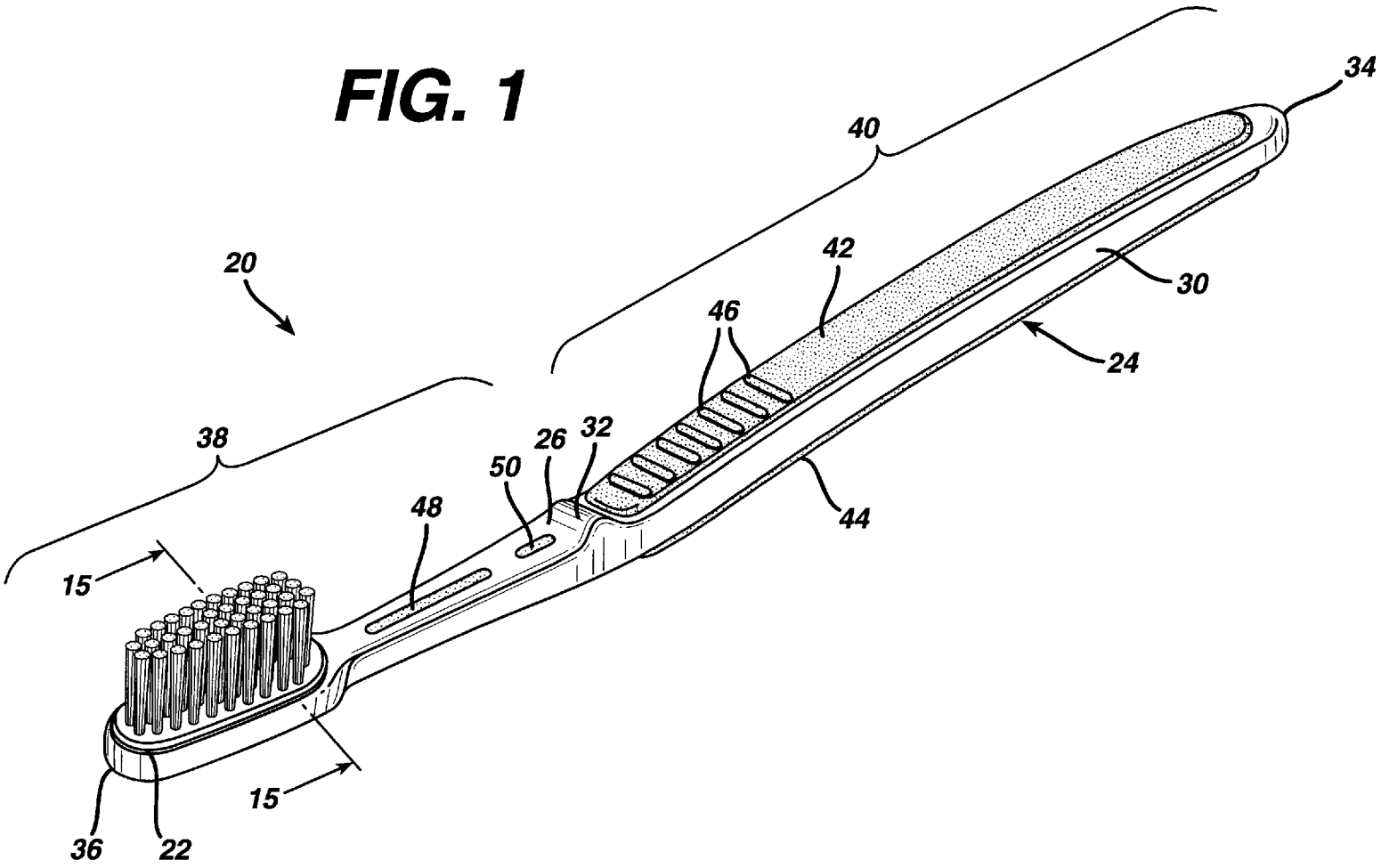
FIG. 1 is a top perspective view of a preferred embodiment of a toothbrush according to the present invention.
Figure 2:
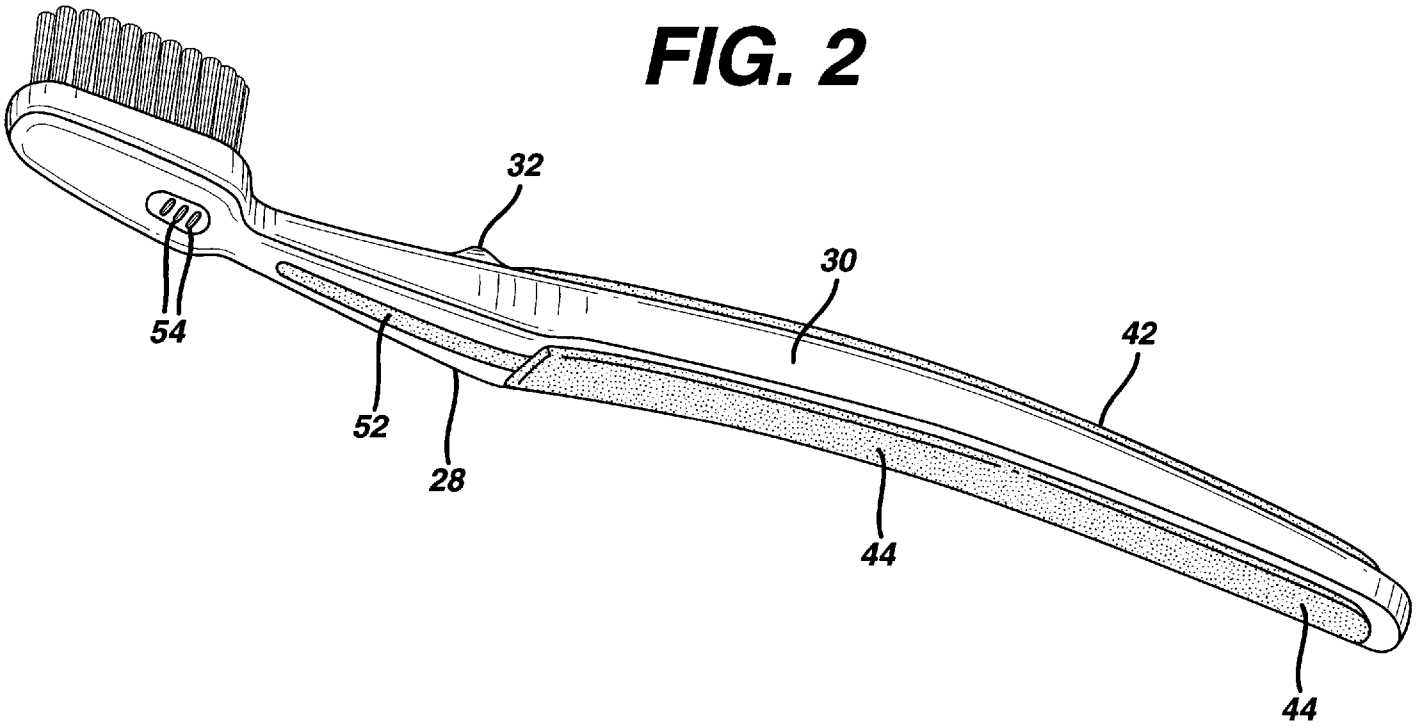
FIG. 2 is a bottom perspective view.
Figure 3:
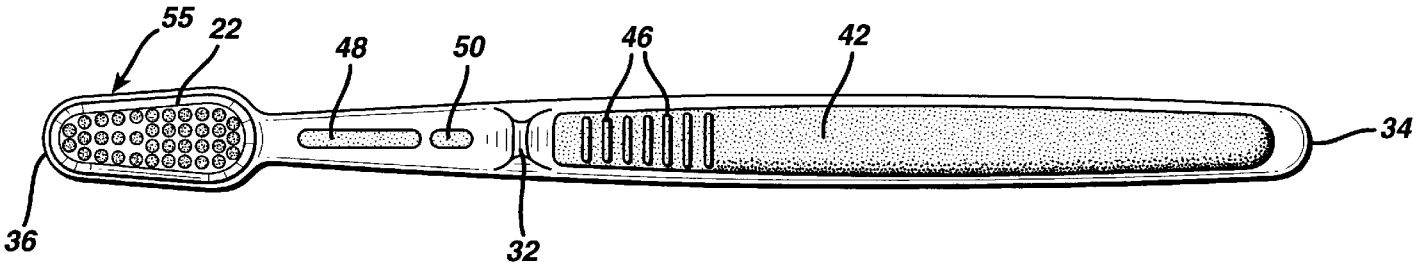
FIG. 3 is a top plan view.
Figure 4:
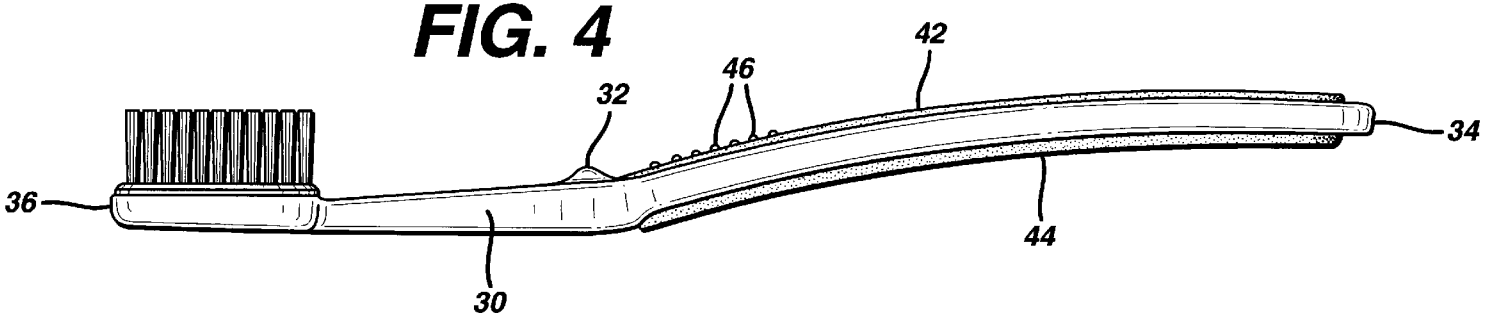
FIG. 4 is a side elevational view, the opposite side being a mirror image thereto.
Figure 5:
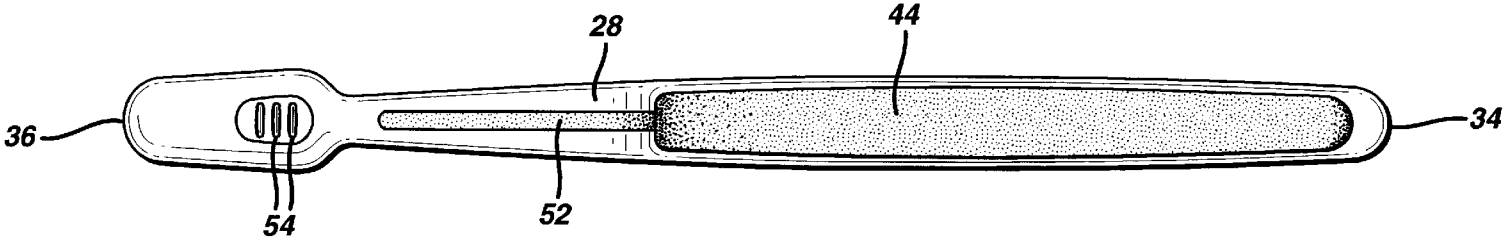
FIG. 5 is a bottom plan view.
Figure 6:
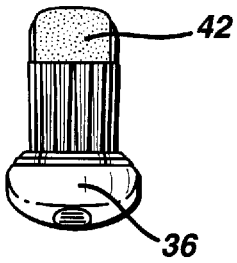
FIG. 6 is a front elevational view.
Figure 7:
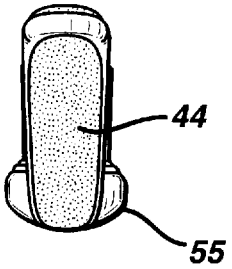
FIG. 7 is a rear elevational view.

Referring to FIGS. 1–8, the handle 24 of the toothbrush 20 of the present invention consists of an upper surface 26 and a lower surface 28 interconnected with a smooth continuous sidewall 30. The upper surface 26 is constructed with a protrusion 32 or bulbous portion which is intermediate opposed ends 34,36 of the handle 24. The protrusion 32 delineates a front region 38 from a rear region 40 of the handle 24. An upper elevated portion 42 extends along the upper surface 26 between the protrusion 32 and the end 34 of the handle 24. A lower elevated portion 44 is constructed along the lower surface of the handle between the protrusion 32 and the end 34 of the handle. Each of the upper elevated portion 42 and the lower elevated portion 44 can be formed with cushionable material to facilitate gripping the handle 24. Preferably, the upper elevated portion 42 is formed with a plurality of ridges 46 which extend from the upper elevated portion 42 and are arranged transverse to a longitudinal axis of the handle 24. The upper surface 26 at the front region 38 of the handle 24 is also provided with regions 48,50 of cushionable material, while the lower surface 28 is provided with a region 52 of cushionable material as well. Preferably, the cushionable region 52 extends along the lower surface 28 to the lower elevated portion 44 as shown in FIGS. 2 and 5.

The brushing head 22 is also provided with ridges 54 of cushionable material to facilitate interchangeability of the brushing head 22 as shown in FIG. 8 and described hereinafter.

The front region 38 of the handle at 55 is constructed with a space 57 such as a recess or cutout. An aperture 59 is formed in the front region 38 of the handle 24 in communication with the space 57 and extending through to the lower surface 28 of the handle 24.

In FIGS. 9–14, the brushing head 22 is shown. The brushing head 22 consists of a platform 56 from which a plurality of grouped bristles 58 extend therefrom. Each one of the bristles 58 extends from the platform 56 to a distance common to that of the other bristles 58. The arrangement of the grouped bristles 58 is more clearly shown with reference to FIG. 12, this group being particularly conducive to effective contact and cleaning of the molar and wisdom teeth.

The platform 56 is provided with a sidewall 60 having a peripheral edge 62.

A base 64 is connected to and formed integral with the platform 56. The base 64 has a continuous sidewall 66 which is sized and shaped to be received in the space 57 at the front region 38 of the handle 24. A plurality of bosses 68 are arranged to extend from the sidewall 66 of the base 64. Preferably, the bosses 68 are spaced apart from each other at opposed sides of the sidewall 66.

A post 70 is connected to or formed integral with the base 64. The post 70 is truncated at 72 at a grade which conforms to the grade of the lower surface 28 of the handle 24. The ridges 54 are disposed along this truncated 72 portion. When the brushing head 22 is removably mounted to the head portion, a surface of the truncated portion 72 is accessible at and substantially uniform with the lower surface 28 of the handle, wherein the ridges 54 project above the lower surface 28 of the handle 24, as shown in FIG. 2, for example.

In FIG. 15, the coaction of the elements of the interchangeable brushing head 22 and the head region of the handle 24 are shown. The post 70 and base 64 of the brushing head 22 are disposed in the space 57 of the handle 24. The platform 56 having a wider diameter than the base 64 and the post 70 is prevented from entering the space in the handle 24. The platform 56 seats on the upper surface 26 of the handle 24. The material of the platform 56 is compatible with that of the handle 24 such that a seal is provided at 74 to prevent water from entering the space 57 of the handle 24. The bosses 68 are formed from a resilient material which deforms upon insertion of the base 64 into the space 57, after which the bosses 68 return to their original projected state to engage an interior step portion 76 at the space 57 in the handle 24. The peripheral edge 62 of the platform sidewall 60 rests against the upper surface 26 at 78. The truncated portion 72 at the post 70 extends through the aperture to the lower surface 28 of the handle such that the cushionable ridges 54 are exposed and accessible.

Removal of the brushing head 22 from the handle 24 is effected by exerting pressure on the ridges 54 of the post 70 after which the bosses 68 deform and give way to such pressure such that the base 64 is ejected from the space in the handle 24. In other words, the elements of the brushing head 22 provide for a "snap-fit" of the brushing head 22 with the handle 24.

The brushing head 22 can be distributed in packaging with the entire toothbrush 20, or in packaging in which one or a plurality of brushing heads 22 are sold. To maintain cleanliness and the hygienics of the product of the toothbrush head 22, it is preferred that each one of the brushing heads 22 is secured in the packaging in its own separate and discrete blister so that removal of one of the brushing heads does not expose the remaining brushing heads to the environment and possibly non-sterile conditions. Of course, it is preferred for the blisters to be constructed of a transparent material so that the cleanliness of the brushing heads 22 can be observed. The packaging for the brushead heads 22 is provided with a hole therethrough, or with a tab with an aperture formed therethrough to hang the package from a display rack. The packaging will also provide instructions to removably mount the brushing head 22 to the handle 24.

In addition, brushing heads 22 can have bristle construction of a different configuration and firmness. The brushing head 22 having different bristles can be selected based upon the sensitivity of the user's teeth and/or gums, or the size of the mouth being brushed.

The materials from which the toothbrush 20 of the present invention is constructed consists of hard resilient polymers for the handle 24 and brushing head 22, and softer resilient rubber-like compositions for the elements 46,48,50,52,54, 68.

It will be understood that the embodiments described herein are merely exemplary and that a person skilled in the art may make many variations and modifications without departing from the spirit and scope of the invention. All such variations and modifications are intended to be included in the scope of the invention as defined in the appended claims.

What is claimed is:

1. A toothbrush, comprising:

a handle comprising:

a first end, a second end opposite to the first end, a first surface extending between the first end and the second end, a second surface extending between the first end and the second end opposite to the first surface, a continuous sidewall interconnecting the first surface and the second surface, a recess constructed and arranged in the first surface at the first end, a lip constructed and arranged along the first surface at the recess and extending inward toward the recess, a protrusion extending from the handle at the first surface intermediate the first end and the second end, a first elevated portion extending along the first surface between the protrusion and the second end, a plurality of ridges projecting from the first elevated portion, each one of the plurality of ridges having a density less than the density of the material from which the remainder of the handle is constructed, an aperture constructed and arranged to extend through the first surface at the recess and the second surface to provide communication between the recess and the second surface, a pair of separate and discrete regions disposed on the first surface between the first end and the protrusion, each region having a density less than a density of the material from which the remainder of the handle is constructed, a second elevated portion extending along the second surface substantially in registration with the first elevated portion, a region of material extending along the second surface between the protrusion and the first end, the region having a density less than the density of the material from which the remainder of the handle is constructed; and a brushing head comprising:

a top, a bottom, a continuous sidewall interconnecting the top and the bottom, at least one resilient mounting member extending from the continuous sidewall for releasable engagement with the lip at the recess, a plurality of bristles extending from the top, a post extending from the bottom opposite to the bristles, the post supporting a region of the brushing head to be accessible at the aperture in the second surface, at least one ridge of cushionable material projecting from the region of the post, a flange extending from the sidewall proximate to the top, the flange spaced apart from the at least one resilient mounting member for providing a space therebetween, the flange coacting with the at least one resilient mounting member to releasably receive the lip in the space to removably mount the brushing head in the recess, wherein coaction between the at least one resilient mounting member and the lip at the recess permits the brushing head to be removably mounted in the recess for the region of the post to be exposed in the aperture for access at the second surface of the handle.

2. A toothbrush, comprising:

a handle comprising:

a first end, the first end having opposite upper and lower surfaces;

a second end opposite to the first end;

a recess constructed and arranged within the first end of the handle, said recess being open at the upper surface bounded at a bottom portion thereof by a wall proximate the lower surface, the recess further being defined by a sidewall extending between the open upper portion thereof and the wall at the lower portion thereof;

an aperture extending through said wall to the lower surface of the handle for providing communication between the recess and said lower surface;

an interior lip portion located at said upper surface about the recess, the sidewall of the recess being substantially linear and free of all surface interruptions from a bottom edge of the interior lip portion to the bottom wall of the recess;

a brushing head comprising:

a base having a top and a bottom;

a plurality of bristles extending from the top of the base;

a peripheral sidewall at the top of the base which extends outwardly therefrom;

a plurality of bosses fixed to a sidewall of the base and spaced a predetermined distance from the peripheral sidewall, the predetermined distance corresponding to the thickness of the interior lip portion of the handle;

a post extending from the bottom of the base which is adapted to fit within the aperture in the handle, the post acting as a means for the user to eject the brushing head from the handle;

wherein the peripheral sidewall of the base is adapted to rest on the upper surface of the handle and further wherein the peripheral sidewall and the plurality of bosses are closely engaged with opposed sides of the interior lip portion when the base is located in the recess;

wherein the bottom of the base rests on a top portion of the wall of the recess when it is located within the recess; and wherein, when the brushing head is located in the recess, the sidewall of the base and the sidewall of the recess define an uninterrupted space extending from a lower edge of the bosses to the bottom wall of the recess.

3. The toothbrush according to claim 2, further comprising:

a protrusion extending from the handle at the upper surface of the handle between the first end and the second end for providing leverage for movement of the handle.

4. The toothbrush according to claim 3, wherein the handle further comprises;

at least one region disposed on the upper surface of the handle between the first end and the protrusion, the at least one region having a density less than a density of the material from which the remainder of the handle is constructed.

5. The toothbrush according to claim 3, further comprising:

a first elevated portion extending along the upper surface between the protrusion and the second end of the handle; and a plurality of ridges projecting from the first elevated portion, each one of the plurality of ridges constructed from a resilient material having a density less than a material from which the remainder of the handle is constructed.

6. The toothbrush according to claim 5, further comprising:

a second elevated portion extending along the lower surface of the handle opposite to the upper surface and substantially in registration with the first elevated portion, the second elevated portion formed of cushionable material to facilitate gripping the handle.

7. The toothbrush according to claim 6, wherein the handle further comprises:

a region of material extending along the upper surface of the handle between the protrusion and the first end, the region of material having a density less than a density of the material from which the remainder of the handle is constructed.

8. The toothbrush according to claim 2, wherein the post comprises:

at least one ridge of cushionable material projecting therefrom.

* * * * *